US005413519A

United States Patent [19]

Simon

[11] Patent Number: 5,413,519

[45] Date of Patent: May 9, 1995

[54] INTERCONNECTED RING TOY

[76] Inventor: Ronald M. Simon, 521 McMillan Ave., Winnipeg, Manitoba R3L 0N4, Canada

[21] Appl. No.: 277,615

[22] Filed: Jul. 20, 1994

[51] Int. Cl.[6] ..... A63H 33/00; A63F 9/08; A44C 9/00

[52] U.S. Cl. ..... 446/487; 446/491; 273/158; 63/15.3

[58] Field of Search ..... 446/487, 491, 489; 273/158, 155; 63/15, 15.1, 15.3, 15.4

[56] References Cited

U.S. PATENT DOCUMENTS

| | | | |
|---|---|---|---|
| 1,972,128 | 9/1934 | Bobbroff | 63/15.3 X |
| 2,817,184 | 12/1957 | Inouye | 446/489 |
| 2,859,971 | 11/1958 | Grant et al. | 273/158 |
| 2,977,699 | 4/1961 | Lofton | 273/158 |
| 5,114,377 | 5/1992 | Cove Mercuri et al. | 446/487 |
| 5,230,631 | 7/1993 | Halmaghi et al. | 446/487 X |

FOREIGN PATENT DOCUMENTS

| | | | |
|---|---|---|---|
| 2117652 | 10/1983 | United Kingdom | 273/158 |

*Primary Examiner*—Robert A. Hafer
*Assistant Examiner*—D. Neal Muir
*Attorney, Agent, or Firm*—Gardner, Carton & Douglas

[57] ABSTRACT

The present invention provides a novel interconnected ring toy effective in reducing the physiological and psychological effects of stress and in improving manual dexterity. The toy is comprised of a plurality of interconnected rings, each ring interconnected with every other ring, the number of rings, ring diameter and ring cross-section chosen to define that amount of free space between the rings which prevents unrestricted movement of the rings yet permits a degree of play to facilitate manipulation of the rings with respect to each other.

9 Claims, 2 Drawing Sheets

INTERCONNECTED RING TOY

FIELD OF THE INVENTION

The present invention relates generally to the field of toys and relates more particularly to non-puzzle type toys effective in providing visual and tactile stimulation to the senses.

BACKGROUND OF THE INVENTION

The present invention relates to toys that are designed to provide relaxing visual and tactile feedback to the senses when manipulated, thus reducing the physiological and psychological effects of stress. Specifically, intentional or idle manipulation of the ring toy of the present invention provides the type of physical activity many individuals find effective in reducing stress. The prior art proposes several different types of interlocking puzzle rings. Such prior art puzzle rings are designed to challenge the operator to assemble the interlocking rings to a specified configuration. Due to the inherently and intentionally complicated nature of the prior art devices, such devices serve to intensify the physiological and psychological effects of stress rather than alleviate those effects.

U.S. Pat. No. 367,896 to Davidson for a "Puzzle-Ring," for example, discloses a puzzle comprised of four independent non-cylindrical loops loosely connected together, but not to every other loop. In other words, the rings of Davidson are not connected to every other ring. When the puzzle loops are placed in a specific association with respect to each other, the bent portion(s) of each respective loop interlocks with the bent portion(s) on the other loops to create a ring which may be worn as an ornament which appears as an ordinary ring.

SUMMARY OF THE INVENTION

It is an object of the invention to provide a ring toy of substantially immutable configuration that is nonetheless manipulable.

It is another object of the invention to provide such a toy that provides visual and tactile stimulation to the senses.

It is another object of the invention to provide such a toy which is effective as a means of reducing the physiological and psychological effects of stress.

It is another object of the invention to provide such a toy which is resistant to disassembly.

It is another object of the invention to provide an interconnected ring toy wherein each ring is interconnected with every other ring so as to provide guided movement of the rings while still limiting the degree to which the rings may be manipulated.

The foregoing and additional objects are realized in the present invention which provides an interconnected ring toy which is manipulable so as to provide an outlet for nervous energy or tension. According to one embodiment of the invention, the interconnected ring toy is preferably comprised of a plurality of interconnected metal rings, which is preferably sized to fit within the palm of a hand so as to permit manipulation of the device and enhance manual dexterity, with minimal effort or concentration. According to such an embodiment, each ring is interconnected with every other ring, the number of rings, ring diameter and ring cross-section chosen to define that amount of free space between the rings which provides guided movement of the rings yet permits a degree of play to facilitate manipulation of the rings with respect to each other.

BRIEF DESCRIPTION OF THE DRAWINGS

Other objects and advantages of the invention will be apparent from the following detailed description and the accompanying drawings, in which.

DETAILED DESCRIPTION OF THE INVENTION

Figure 1:
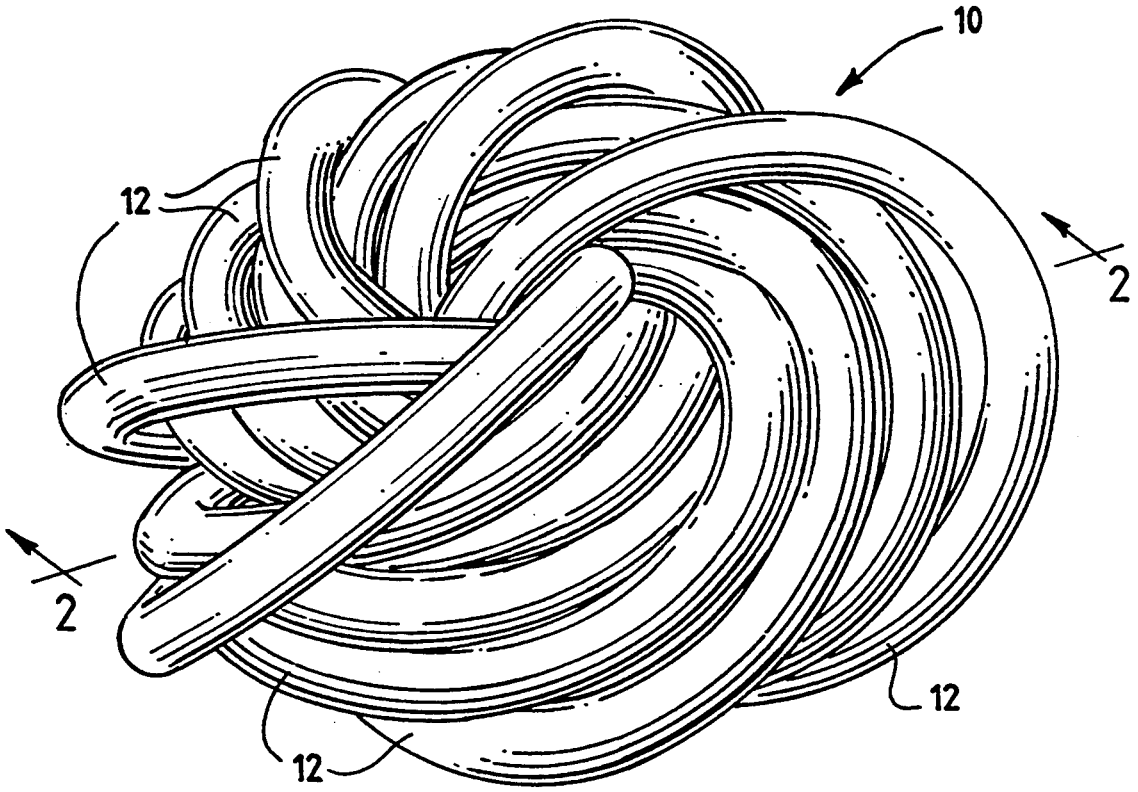
FIG. 1 is a perspective view illustrating an interconnected ring toy according to a preferred embodiment of the present invention.

While the invention is susceptible to various modifications and alternative forms, a certain preferred embodiment is shown by way of example in the drawings and will herein be described in detail. It should be understood, however, that it is not intended to limit the invention to the particular forms described, but to the contrary, the intention is to cover all modifications, equivalents, and alternatives falling within the spirit and scope of the invention as defined by the appended claims.

Turning now to the drawings, FIG. 1 illustrates an interconnected ring toy of the present invention according to a preferred embodiment. According to the illustrated embodiment, the invention is an interconnected ring toy 10 preferably comprised of a plurality of interconnected rings 12, for example, 10 to 40 interconnected rings. Each ring 12 is generally the same size and shape, preferably with a substantially smooth finish to facilitate smooth movement of each ring with respect to the other rings. Alteratively, according to some embodiments of the invention where the interconnected ring toy is of a size that may be readily manipulated within the palm of a hand, the device may be comprised of between approximately 12 to 20 interconnected rings. Such a hand-manipulable embodiment will preferably be comprised of rings of substantially the same size, for example, with a ring diameter ranging from about ½ inch in smaller versions to about 3 or more inches in larger versions. The rings are preferably comprised of a durable, substantially nondeformable metal such as steel.

Figure 2:
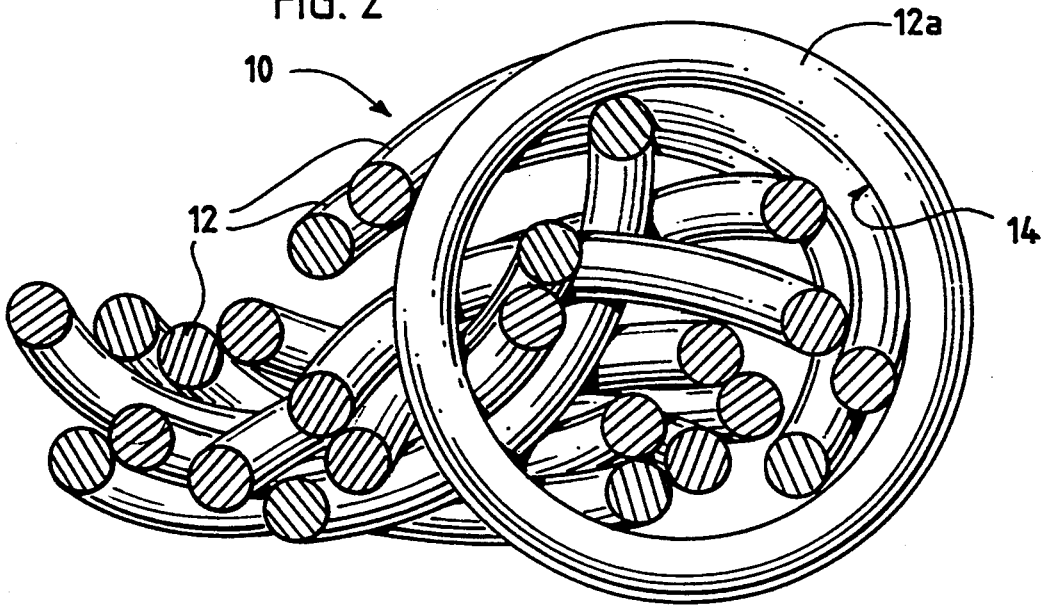
FIG. 2 is a cross-section view, taken at line 2—2 of FIG. 1, illustrating the interconnected nature of the ring toy according to a preferred embodiment of the present invention.

Turning now to FIG. 2, which is a cross-sectional view taken at line 2—2 of FIG. 1, there is more clearly illustrated that every each ring 12 is interconnected with every other ring. Illustrated by way of example, through the inner closed loop 14 formed by ring 12*a* passes every other ring 12 of the interconnected ring toy of the present invention. This fundamental principle applies for each ring of the present invention, i.e., that every ring is interconnected with every other ring. The interconnectedness of each ring with respect to each other ring ensures that the configuration of rings is substantially immutable, yet still manipulable.

Figure 3:
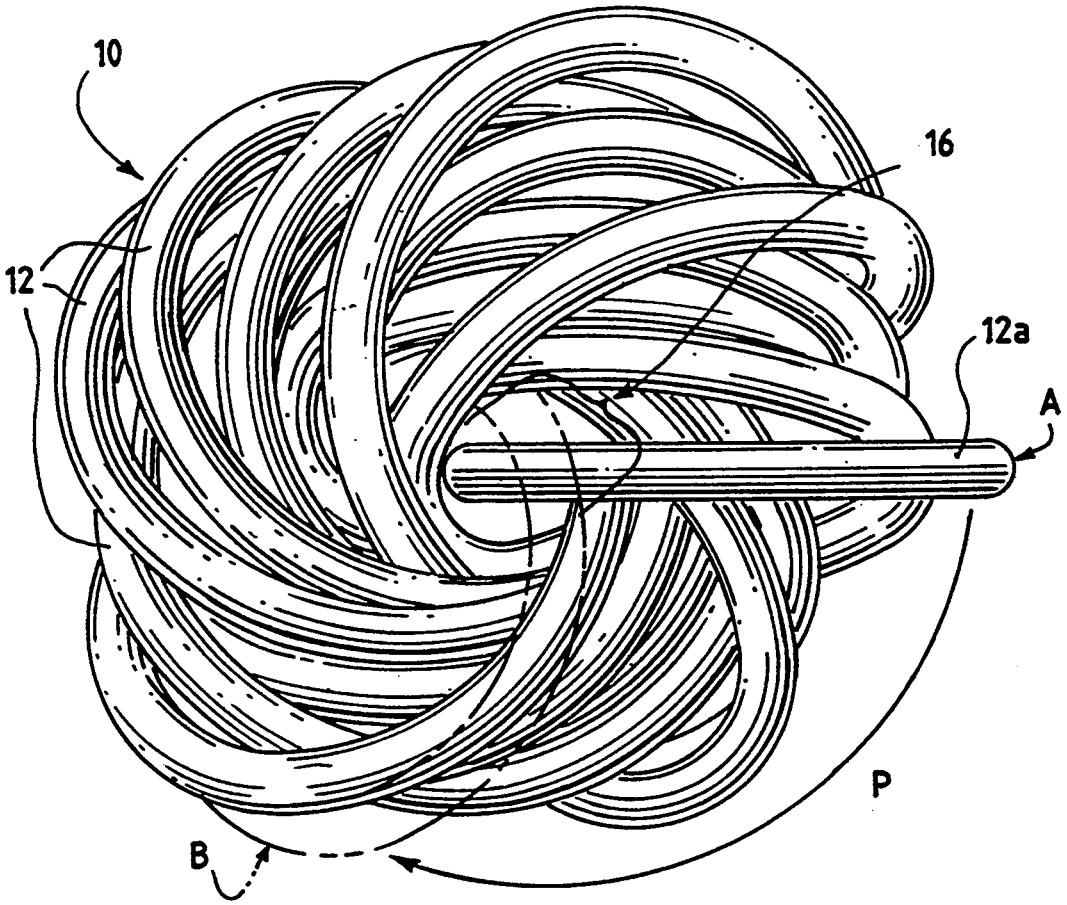
FIG. 3 is a top view of the interconnected ring toy of the invention according to a preferred embodiment which illustrates the desired relative movement of the rings.

Turning now to FIG. 3, there is illustrated, by way of example, the manner in which a particular ring 12*a* may be manipulated with respect to the other rings 12. In addition, FIG. 3 rather clearly illustrates the central internal region and the "gap" of the interconnected ring toy, which is an important feature in defining the desired relative movement of the rings. As should be evident from the illustrated preferred embodiment 10, each ring 12 may be rotated generally about its midpoint, the center of rotation being defined, at least in part, by the inner diameter of the ring 12 and the number and cross-section of the rings 12 with which the rotated ring 12 is interconnected. Each ring 12 may be manipulated laterally with respect to the other interconnected rings 12. In fact, each ring 12 may be manipulated as a hoop which may be rotated about the circumference of the toy 10. However, because each ring 12 is generally the same size and shape, the position of the rings adjacent to any given ring generally remain the same near the hub or central internal region 16 of the toy where the gap exists. That is, the relative positional location in the toy 10 of any ring with respect to the two rings immediately adjacent to it, one adjacent ring on each side, remains essentially the same, except that the distance between the manipulated ring and each immediately adjacent ring may vary according to the degree of lateral and rotational movement permitted by the limited amount of unoccupied (i.e., ringless) space provided within central internal region of the toy.

Illustrated by way of example is the movement of one ring 12*a* from a first position A to a second position B. As can be seen, the present configuration of the central internal region 16 provides a gap which allows for movement of ring 12*a*. Ring 12*a* may be easily manipulated, by hand, for example, from position A, traversing generally a path indicated by arrows P, until the ring 12*a* reaches position B where it abuts with other rings which temporarily prevent further movement along the path P. As illustrated, the movement of the ring 12*a* along path P may be relatively easily achieved through manipulation by hand and is guided by the presence and position of the other interconnected rings 12 of the toy 10.

In order to provide the important and desired movement in accordance with the invention, the number of rings 12 comprising the toy 10 is important and is a function of the size and shape (i.e., cross-section and diameter) of the rings. The number of rings chosen should permit guided, yet relatively easy manipulation of the rings, where the guidance of any single ring is provided by the presence of and association with the other interconnected rings. If too many rings are interconnected, then frictional forces between the rings, particularly near the common internal intersection, hampers smooth, yet guided, manipulation of the rings. If too few rings are interconnected, then the entire configuration will be too loose and movement of the rings will not be smooth or adequately guided by the other interconnected rings.

According to a preferred embodiment, the number of rings interconnected should be approximately between 2 and 5 rings less than the maximum number of rings that can be interconnected before no more rings can be included due to the lack of room in the central internal region for interconnecting an additional ring. That is, the "gap" (i.e., the free space in the central internal region 16) in the interconnected ring toy 10 should be able to accommodate approximately 2 to 5 additional rings. As illustrated, the central internal region is generally indicated with bracket 16, and includes a gap or free space for movement. The size of the gap, as can be seen, is approximately the same as the thickness of about 2 to 5 rings 10. Thus, although such a gap indicates that the toy could accommodate about 2 to 5 additional interconnected rings 12, such additional rings are not included in order to provide the relatively easy, yet guided, manipulation of the rings 12 of the invention.

Figure 4:
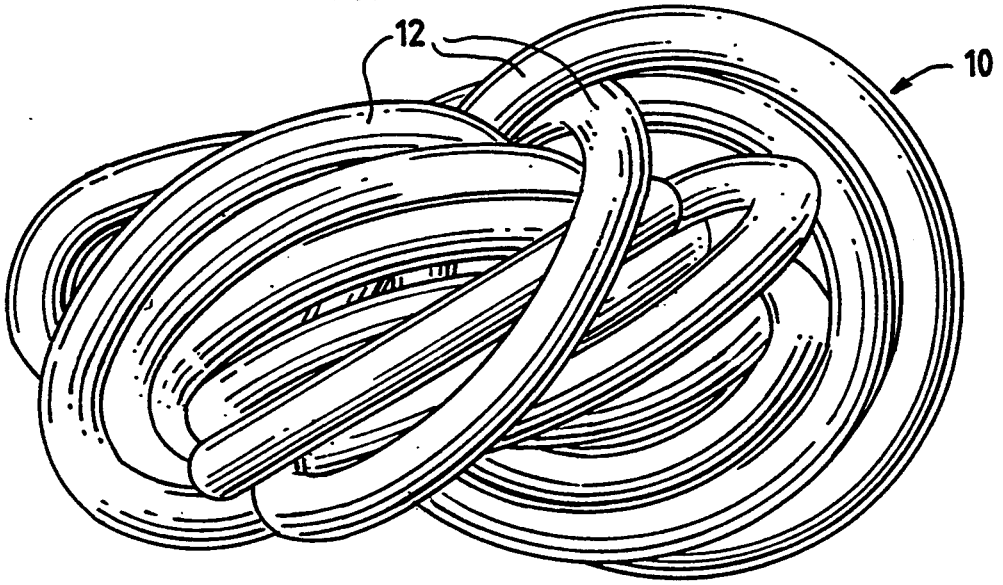
FIG. 4 is a side view illustrating the interconnected ring toy according to a preferred embodiment of the present invention.

FIG. 4 illustrates a side view of the interconnected ring toy 10 of the present invention according to a preferred embodiment, and depicts the interconnectedness of each of the rings 12 with respect to every other ring 12.

As should be evident, the interconnected ring toy, according to the present invention, may be manufactured and assembled using a number of different techniques. According to one assembly technique, the first ring is comprised of a straight, cylindrical cross-section strip of metal whose opposing ends are essentially flat in cross-section. Alternatively, the cylindrical metal strip may initially be in the shape of a "C"-ring. The strip or "C"-ring is closed into an "O"-ring shape having a substantially constant diameter until the opposing ends of the strip contact one another, the entire cross-sectional surface of one end in contact with the entire cross-sectional surface of the other end. The rigidity of the metal ensures that the opposing ends of the strip maintain contact with one another and that there is no lateral displacement of either end with respect to the other end. In some cases and for some materials, it may be preferable to weld, solder or otherwise fuse the two ends of the ring together.

The second ring is formed as the first, however, before the two opposing ends of the metal strip are placed in contact with one another, one end of the second strip is inserted through the opening formed by the first ring. The opposing ends of the second ring are then brought into contact with one another, as in the first ring, thus interconnecting the first and second ring.

Similarly, the third ring is formed as the first, however, before the two opposing ends of the metal strip are placed in contact with one another, one end of the third strip is inserted through the opening formed by the first ring and the opening formed by the second ring. The opposing ends of the third ring are then brought into contact with one another, as in the first ring, thus interconnecting the third ring to both the first ring and the second ring. The process is repeated for each additional ring to be formed until the desired number of rings have been interconnected to each other, each ring interconnected to every other ring.

According to an alternative embodiment, the interconnected ring toy is manufactured and assembled as above, however, the opposing ends of each metal strip/ring are soldered together so as to secure one end to the other. According to another alternative embodiment, the interconnected ring toy is manufactured and assembled utilizing a material other than metal, such as plastic, the opposing ends of each plastic strip/ring fixedly attached to each other by, for example, an adhesive compound. According to yet another alternative embodiment, the interconnected rings are comprised of a precious or semi-precious metal which may then be secured, for example, to an article of clothing as an ornamental accoutrement.

As can be seen from the above detailed description and examples, the present invention provides a novel toy for providing visual and tactile feedback to the senses when manipulated, thus reducing physiological and psychological stress, and for improving manual dexterity. The manipulation of the present invention, comprised of a plurality of interconnected rings, each ring interconnected with every other ring, is inherently less complex than the manipulation of prior art puzzle-type rings, thus permitting manipulation with minimal effort or concentration.

What is claimed is:

1. A stress-relieving, manipulable ring toy comprised of a plurality of at least 10 essentially annular ring elements, each ring element defining a central aperture and a portion of each ring element disposed within said central aperture of each other ring element, said plurality of ring elements providing guided means for manipulating each said ring.

2. The toy of claim 1 wherein said ring elements have substantially uniform inner diameter and outer diameter.

3. The toy of claim 2 wherein said ring elements have substantially uniform cross-section.

4. The toy of claim 3 wherein said ring elements are comprised of a straight cylindrical strip of substantially rigid material bent to shape, each cross-sectional end of said strip in substantial abutment with the opposing cross-sectional end of said strip.

5. The toy of claim 4 wherein said cylindrical strip is comprised of metal, said each end of said strip fixedly attached to said opposing end of said strip.

6. The toy of claim 4 wherein said cylindrical strip is comprised of plastic, said each end of said strip fixedly attached to said opposing end of said strip.

7. The toy of claim 4 wherein the number of said ring elements is such as to limit the amount of free space between said ring elements while still permitting a degree of play with respect to each said ring element.

8. A stress-relieving, manipulable ring toy comprised of a plurality of at least 10 essentially annular ring elements, each ring element defining a central aperture, a portion of each ring element being disposed within said central aperture of each other ring element, and the number of said ring elements selected such that there is a gap in the central aperture region which is approximately on the order of the thickness of about 5 or fewer ring elements.

9. The ring toy of claim 8 wherein the gap in the central aperture region is approximately on the order of the thickness of about at least 2 ring elements.

* * * * *